US006461219B1

(12) United States Patent
Fung

(10) Patent No.: US 6,461,219 B1
(45) Date of Patent: Oct. 8, 2002

(54) ANIMATED DISPLAY

(75) Inventor: Chun Chung Fung, Hong Kong (HK)

(73) Assignee: Packway Industries Limited, Hong Kong (HK)

( * ) Notice: Subject to any disclaimer, the term of this patent is extended or adjusted under 35 U.S.C. 154(b) by 0 days.

(21) Appl. No.: 10/054,519

(22) Filed: Jan. 22, 2002

(30) Foreign Application Priority Data

Jan. 10, 2002 (GB) ..... 0200510

(51) Int. Cl.[7] ..... A63H 3/00
(52) U.S. Cl. ..... 446/357; 40/414
(58) Field of Search ..... 446/352, 353, 446/357, 330, 484, 485, 486, 175, 3; 40/411, 414, 427

(56) References Cited

U.S. PATENT DOCUMENTS 5,108,307 A * 4/1992 Cohen ..... 40/411
5,438,154 A * 8/1995 Segan et al. ..... 368/273
6,110,000 A * 8/2000 Ting ..... 446/175

* cited by examiner

*Primary Examiner*—Jacob K. Ackun
(74) *Attorney, Agent, or Firm*—Jackson Walker L.L.P.

(57) ABSTRACT

An animated display includes two or more interconnected animated display items. Each display item includes a base member supporting a motion device. The motion device is driven by an electric motor and is in communication with a flexible display covering. One display item has a sensor operable to provide an activation signal. The display items are interconnected via wiring connecting the sensor to electric motors in other display items. There may be a light inside the flexible display covering, the wiring connecting the sensor to the light in each display item.

10 Claims, 2 Drawing Sheets

ANIMATED DISPLAY

FIELD OF THE INVENTION

The invention relates to animated displays, and in particular to an array or sting of two or more interconnected animated display items.

BACKGROUND TO THE INVENTION

Animated display items, such as figurines are well-known. Such animated display items may be interconnected in a display however a substantial power supply and interconnecting wiring is required.

SUMMARY OF THE INVENTION

It is an object of the present invention to provide an animated display which overcomes the above-mentioned disadvantages, or at least which provides the public with a useful alternative.

According to a first aspect of the invention there is provided an animated display including two or more interconnected animated display items, each display item including a base member supporting a motion device driven by an electric motor and in communication with a flexible display covering, at least one display item having a sensor operable to provide an activation signal, and wiring connecting the sensor to electric motors in other display items.

Preferably, only one display item has a sensor operable to provide the activation signal The sensor may be a motion sensor, or a sound sensor.

Preferably, the electric motors are connected in parallel to the sensor.

Each display item may further include a light inside the flexible display covering, the wiring connecting the sensor to the light in each display item.

Preferably, the lights are connected in series with the sensor.

Each display item may further include one or more lights on the outside of the flexible display covering, the wiring connecting the sensor to the lights on each display item.

Further aspects of the invention will become apparent from the following description, which is given by way of example only.

BRIEF DESCRIPTION OF THE DRAWINGS

Embodiments of the invention will now be described by way of example only and with reference to the accompanying drawings in which.

DESCRIPTION OF THE PREFERRED EMBODIMENTS

Figure 1:
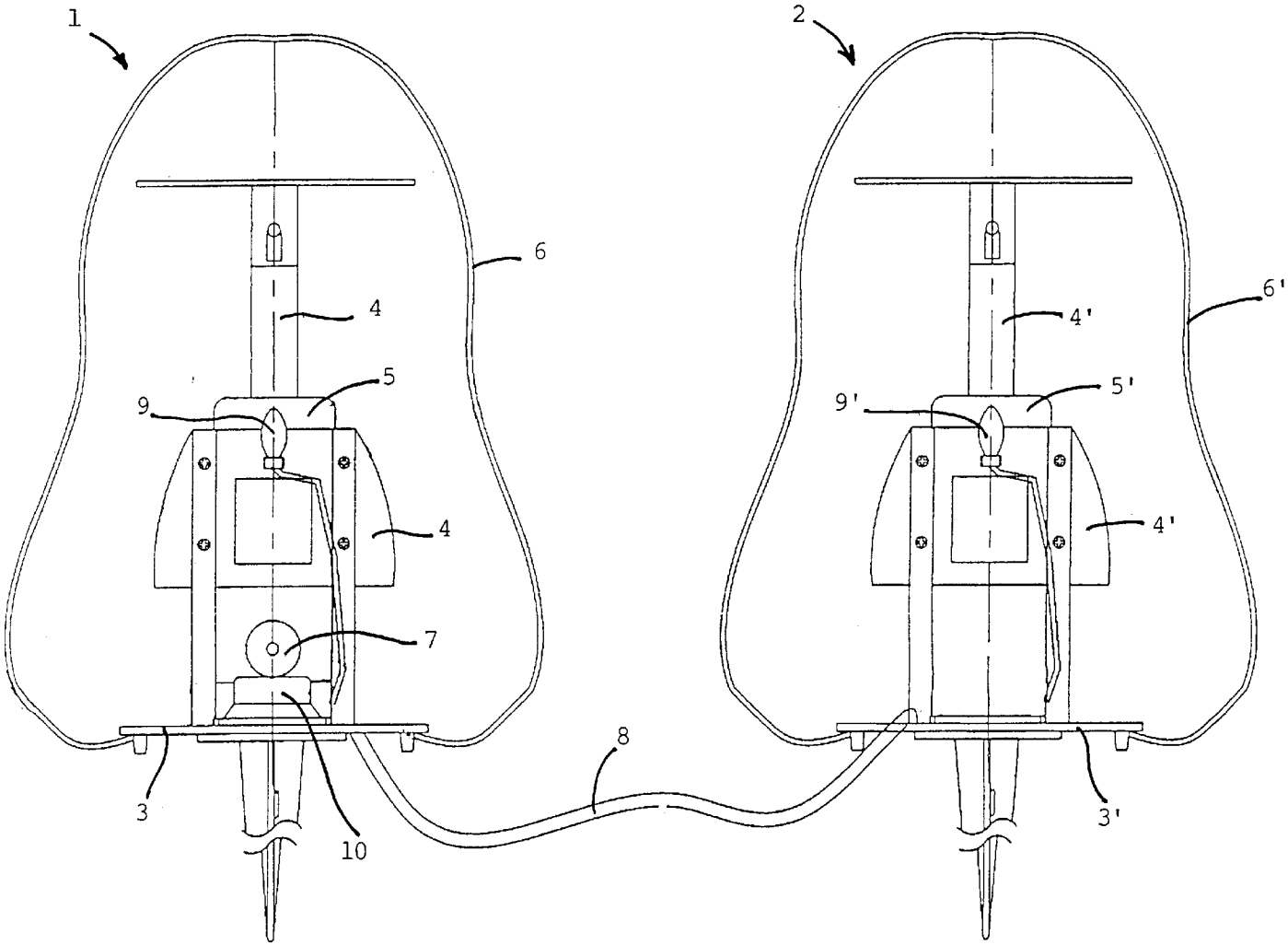
FIG. 1 illustrates, in cross section, an animated display comprising two interconnected display items.

An animated display according to the invention includes two interconnected animated display items 1 and 2. Each display item 1 and 2 comprises a base member 3 for supporting the item. Mounted on the base member 3 is a motion device 4. The motion device 4 is driven by an electric motor 5. In communication with the motion device 4 is a flexible displays covering such as doll rubber skin 6. When the electric motor 5 is activated the motion device 4 wobbles or oscillates and transmits this wobble or oscillation to the flexible doll covering 6. The display items 1, 2 appear to dance.

So as to save power and prolong the display life the display items 1, 2 only activate when a person is nearby. The first display item 1 includes a sensor 7. The sensor 7 is operable, to provide an activation signal to the electric motors 5, 5'. A wire 8 containing four cores interconnects the display items 1 and 2. Two cores of the wire 8 connect the sensor 7 to the electric motor 5' in the second display item 2.

Because of the nature of commutation of the armature in the electric motors 5 it is preferable that the electric motors 5, 5' are connected to the sensor 7 in parallel.

The sensor 7 may be any applicable sensor to detect the approach of a person. Such sensors include motion, sound, or vibration. Only having one sensor allows activation of one or more display items at a lower cost.

The flexible display covering 6 may be semi-transparent. Each display item may also include a light 9 for illuminating the display item while it is activated. The third and fourth cores in the wire 8 connect the sensor 7 to the lights 9, 9'. In order to reduce the power requirement of a string, or array, of interconnected display items the lights 9, 9' are connected in series.

Figure 2:
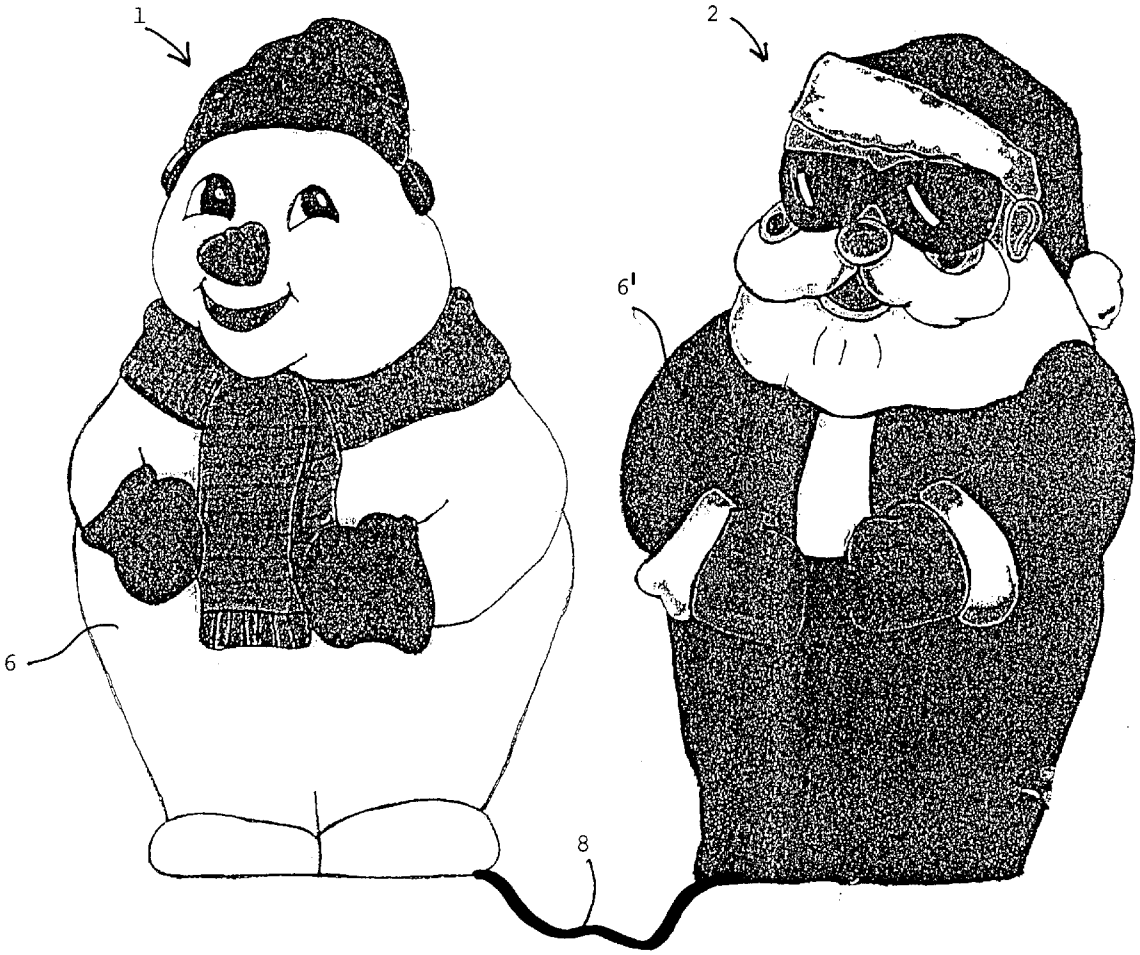
FIG. 2 illustrates the animated display covers.

The display items may be in the form of figurines such as the wobbly snowman and wobbly Father Christmas illustrated in FIG. 2.

In one embodiment of the invention one or more lights (not shown) are placed on the outside of the flexible display covering 6. These lights may be illuminated buttons on the figurines clothing, or illuminated eyes, or an illuminated nose for examples. The lights on the outside of the flexible covering 6 are connected to the sensor 7 via the third and fourth cores of the wiring 8.

In the illustrated embodiment there are only two display items 1 and 2. Other embodiments of the invention include more display items. For example, there may be 6, 8, 10 or 12 display items in a string or array. The electric motors 5 in each display items are connected in parallel and the lights 9 in each display items are connected in series. A four core wire 8 connects each display items in the string or array.

In other embodiments of the invention the display items include a speaker 10 to play a tune while the animated display is activated.

Where in the foregoing description reference has been made to integers or elements have known equivalents then such are included as if individually set forth herein.

Embodiments of the invention have been described, however it is understood that variations, improvement or modifications can take place without departure from the spirit of the invention or scope of the appended claims.

I claim:

1. An animated display including two or more interconnected animated display items, each display item including a base member supporting a motion device driven by an electric motor and in communication with a flexible display covering, at least one display item having a sensor operable to provide an activation signal, and wiring connecting the sensor to electric motors in other display items.

2. An animated display as claimed in claim 1 wherein only one display item has a sensor operable to provide the activation signal.

3. An animated display as claimed in claim 1 wherein the sensor is a motion sensor.

4. An animated display as claimed in claim 1 wherein the sensor is a sound sensor.

5. An animated display as claimed in claim 1 wherein the electric motors are connected in parallel to the sensor.

6. An animated display as claimed in claim 1 wherein each animated display device further includes a light inside the flexible display covering, the wiring connecting the sensor to the light in each display item.

7. An animated display as claimed in claim 6 wherein the lights are connected in series with the sensor.

8. An animated display as claimed in claim 1 wherein each animated display device further includes one or more lights on the outside of the flexible display covering, the wiring connecting the sensor to the lights on each display item.

9. An animated display including two or more interconnected animated display items, each display item including a base member supporting a motion device driven by an electric motor and in communication with a flexible display covering, one display item having a motion sensor operable to provide an activation signal, and wiring connecting the sensor to the electric motors in the display items.

10. An animated display including two or more interconnected animated display items, each display item including a base member supporting a motion device driven by an electric motor and in communication with a flexible display covering, and a light inside the flexible display covering, one display item having a motion sensor operable to provide an activation signal, and wiring connecting the motion sensor to the electric motors and lights in the display items, the electric motors being connected in parallel and the lights being connected in series.

* * * * *